US010216115B2

(12) United States Patent
Kidaka

(10) Patent No.: US 10,216,115 B2
(45) Date of Patent: Feb. 26, 2019

(54) APPARATUS AND METHOD FOR FORMING AN ELECTROSTATIC IMAGE ON A PHOTOSENSITIVE MEMBER ACCORDING TO AN IMAGE SIGNAL

(71) Applicant: CANON KABUSHIKI KAISHA, Tokyo (JP)

(72) Inventor: Hiroyuki Kidaka, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/921,370

(22) Filed: Mar. 14, 2018

(65) Prior Publication Data

US 2018/0275555 A1 Sep. 27, 2018

(30) Foreign Application Priority Data

Mar. 22, 2017 (JP) ..... 2017-056257

(51) Int. Cl.
*G03G 15/20* (2006.01)
*G03G 15/02* (2006.01)
*G03G 15/00* (2006.01)

(52) U.S. Cl.
CPC ..... *G03G 15/0283* (2013.01); *G03G 15/0216* (2013.01); *G03G 15/5004* (2013.01); *G03G 2215/0607* (2013.01)

(58) Field of Classification Search
CPC ..... G03G 15/0283
USPC ..... 399/50
See application file for complete search history.

(56) References Cited

U.S. PATENT DOCUMENTS 8,005,380 B2 * 8/2011 Kubo ..... G03G 15/0283 399/50

FOREIGN PATENT DOCUMENTS

| | | | |
|---|---|---|---|
| JP | 3457083 | B2 | 10/2003 |
| JP | 2016-133781 | A | 7/2016 |
| JP | 2016-145915 | A | 8/2016 |
| JP | 2017-032778 | A | 2/2017 |

* cited by examiner

*Primary Examiner* — Quana M Grainger
(74) *Attorney, Agent, or Firm* — Canon U.S.A., Inc. IP Division

(57) ABSTRACT

A control unit performs control to satisfy $T_{Va}<T\ T_{Vb}$, where T is a time from a point when irradiation with light by a pre-exposure member is started to a point when a predetermined portion of the photosensitive member which is located at the pre-exposure position when the irradiation is started reaches a charging position, $T_{Va}$ is a time from the point when the irradiation is started to a point when application of a first voltage is started, and $T_{Vb}$ is a time from the point when the irradiation is started to a point when application of the second voltage is started.

20 Claims, 5 Drawing Sheets

-- Comparison Example --

-- Comparison Example --

APPARATUS AND METHOD FOR FORMING AN ELECTROSTATIC IMAGE ON A PHOTOSENSITIVE MEMBER ACCORDING TO AN IMAGE SIGNAL

BACKGROUND OF THE INVENTION

Field of the Invention

The aspect of the embodiments relates to an image forming apparatus such as a copying machine, a printer, a facsimile machine, or a multi-function peripheral having two or more of copy, print, and facsimile functions and a method for controlling the image forming apparatus.

Description of the Related Art

In electrophotographic image forming apparatuses, the surface of a photosensitive member is charged by a charging member and thereafter scanned and exposed by an image exposure member according to image information to form an electrostatic image (electrostatic latent image) on the photosensitive member. Further, a development member supplies toner to the electrostatic image formed on the photosensitive member to form a toner image on the photosensitive member. The toner image formed on the photosensitive member is transferred by a transfer member onto a recording material, such as a sheet, or a transfer-target member, such as an intermediate transfer member.

In recent years, a charging member which is disposed in contact with a photosensitive member and to which a voltage is applied to charge the photosensitive member is widely used because such a charging member is beneficial in reducing ozone and power consumption. Examples of charging methods using such a charging member include a "direct-current (DC) charging method" in which a charging voltage consisting of only a DC voltage (DC component) is applied to the charging member to charge a photosensitive member. The DC charging method is beneficial in that it requires no alternating-current (AC) power source to realize a simpler structure, etc. In the DC charging method, a voltage which is higher than a threshold voltage is applied to the charging member to start charging the surface of the photosensitive member, and the surface potential of the photosensitive member changes substantially linearly to the voltage which is higher than the threshold voltage.

After the photosensitive member passes through a transfer position, the surface potential of the photosensitive member becomes non-uniform due to an effect of a voltage applied to a transfer member. In the DC charging method, the potential leveling effect of AC discharge, which is produced by a method using as a charging voltage a oscillating voltage in which a DC voltage (DC component) and an AC voltage (AC component) are superimposed, cannot be obtained. Thus, in the DC charging method, if the photosensitive member having a non-uniform surface potential after passing through the transfer position is charged and the next image is formed, the uniformity of the surface potential of the photosensitive member after passing through the charging position is often impaired. If the uniformity of the surface potential of the photosensitive member is impaired, the potential difference between the photosensitive member and a developer agent bearing member of a development member varies significantly, and this can cause image defects due to a fog phenomenon, carrier adhesion, etc. The fog phenomenon is a phenomenon in which toner adheres to a non-image portion to which no toner is supposed to adhere, and this phenomenon can occur if the absolute value of the charging potential of the photosensitive member is excessively less than the absolute value of the potential of the developer agent bearing member or if the surface potential of the photosensitive member is reversed with respect to the normal charging polarity. Further, the carrier adhesion is a phenomenon in which carrier of a two-component developer agent which is supposed to be borne on the developer agent bearing member and not supposed to adhere to the photosensitive member adheres to the photosensitive member, and this phenomenon occurs if the absolute value of the charging potential of the photosensitive member is significantly greater than the absolute value of the potential of the developer agent bearing member.

In response to the foregoing situation, Japanese Patent No. 3457083 discusses a pre-exposure member which is provided to irradiate a photosensitive member with light at a position located downstream of a transfer position and upstream of a charging position in the rotation direction of the photosensitive member and eliminate (neutralize) at least some of residual charges of the photosensitive member.

As described above, in order to uniform the surface potential of the photosensitive member having passed through the charging position, the surface of the photosensitive member irradiated with light by the pre-exposure member is charged. When a pre-rotation operation which is a preparatory operation performed before an image is formed is started, if the surface of the photosensitive member between a pre-exposure position and the charging position which is not irradiated with light by the pre-exposure member is charged, the following situation can occur. Specifically, in a case where the surface is a region on which no image forming is performed yet, the back of a recording material can be contaminated due to a fog phenomenon or carrier adhesion caused by an abnormal potential of the photosensitive member. Further, in a case in which the surface is a region on which image forming is to be performed or is performed, the image density can become uneven due to a potential difference (dark decay difference) between a boundary portion irradiated with light by the pre-exposure member and a boundary portion not irradiated with light by the pre-exposure member.

The above-described situation is solved if the application of a voltage to the charging member is started after the surface of the photosensitive member irradiated with light by the pre-exposure member reaches the charging position. In this case, however, the timing to start charging processing is delayed, so the time from the giving of an instruction to start forming an image until the output of the first image, i.e., first copy time (hereinafter, also referred to as "FCOT"), increases.

SUMMARY OF THE INVENTION

According to an aspect of the embodiments, an apparatus includes a photosensitive member, a driving source configured to rotate the photosensitive member, a charging roller configured to charge the photosensitive member to a predetermined surface potential at a charging position, a first power source configured to apply to the charging roller a charging voltage of a direct current only, wherein the charging voltage includes a first voltage and a second voltage, and wherein an absolute value of the first voltage is higher than zero volts and not higher than a discharge start voltage and an absolute value of the second voltage is higher than the discharge start voltage, an image exposure device configured to form an electrostatic image on the photosensitive member by exposing according to an image signal the photosensitive member charged by the charging roller to which the second voltage is applied, a development device including a development sleeve and configured to supply toner to the electrostatic image on the photosensitive member at a development position to form a toner image, a second power source configured to apply to the development sleeve a development bias containing a direct-current component, a transfer member configured to transfer the toner image on the photosensitive member onto a transfer-target member at a transfer position, a pre-exposure member configured to irradiate the photosensitive member with light at a pre-exposure position located downstream of the transfer position and upstream of the charging position in a rotation direction of the photosensitive member, and a control unit configured to cause, in a case where the charging roller charges the photosensitive member after the driving source starts rotating the photosensitive member, after causing the charging voltage to rise to the first voltage, the charging voltage to rise from the first voltage to the second voltage so that a temporal change in an absolute value of the charging voltage has a predetermined rise shape and configured to cause the development bias to rise so that an absolute value of the direct-current component of the development bias has the rise shape when a charged region of the photosensitive member passes through the development position, the control unit performing control to satisfy $T_{Va}+t_{Va} \leq T_{Vb} < T \leq T_{Vb}+t_{Vb}$, where T is a time from a point when the irradiation with the light by the pre-exposure member is started to a point when a predetermined portion of the photosensitive member which is located at the pre-exposure position when the irradiation is started reaches the charging position, $T_{Va}$ is a time from the point when the irradiation is started to a point when application of the first voltage is started, $t_{Va}$ is a time from the point when the application of the first voltage is started to a point when a rise of the first voltage is completed, $T_{Vb}$ is a time from the point when the irradiation is started to a point when application of the second voltage is started, and $t_{Vb}$ is a time from the point when the application of the second voltage is started to a point when a rise of the second voltage is completed.

According to another aspect of the embodiments, an apparatus includes a photosensitive member, a driving source configured to rotate the photosensitive member, a charging roller configured to charge the photosensitive member to a predetermined surface potential at a charging position, a first power source configured to apply to the charging roller a charging voltage of a direct current only, wherein the charging voltage includes a first voltage and a second voltage, and wherein an absolute value of the first voltage is higher than zero volts and not higher than a discharge start voltage and an absolute value of the second voltage is higher than the discharge start voltage, an image exposure device configured to form an electrostatic image on the photosensitive member by exposing according to an image signal the photosensitive member charged by the charging roller to which the second voltage is applied, a development device including a development sleeve and configured to supply toner to the electrostatic image on the photosensitive member at a development position to form a toner image, a second power source configured to apply to the development sleeve a development bias containing a direct-current component, a transfer member configured to transfer the toner image on the photosensitive member onto a transfer-target member at a transfer position, a pre-exposure member configured to irradiate the photosensitive member with light in a pre-exposure position located downstream of the transfer position and upstream of the charging position in a rotation direction of the photosensitive member, and a control unit configured to cause, in a case where the charging roller charges the photosensitive member after the driving source starts rotating the photosensitive member, after causing the charging voltage to rise to the first voltage, the charging voltage to rise from the first voltage to the second voltage so that a temporal change in an absolute value of the charging voltage has a predetermined rise shape and configured to cause the development bias to rise so that an absolute value of the direct-current component of the development bias has the rise shape when a charged region of the photosensitive member passes through the development position, the control unit performing control to satisfy $T_{Va} < T \leq T_{Vb}$, where T is a time from a point when the irradiation with the light by the pre-exposure member is started to a point when a predetermined portion of the photosensitive member which is located at the pre-exposure position when the irradiation is started reaches the charging position, $T_{Va}$ is a time from the point when the irradiation is started to a point when application of the first voltage is started, and $T_{Vb}$ is a time from the point when the irradiation is started to a point when application of the second voltage is started.

Further features of the disclosure will become apparent from the following description of exemplary embodiments with reference to the attached drawings.

DESCRIPTION OF THE EMBODIMENTS

An image forming apparatus according to an exemplary embodiment of the disclosure will be described in further detail below with reference to the drawings.

1. Overall Structure and Operation of Image Forming Apparatus

Figure 1:
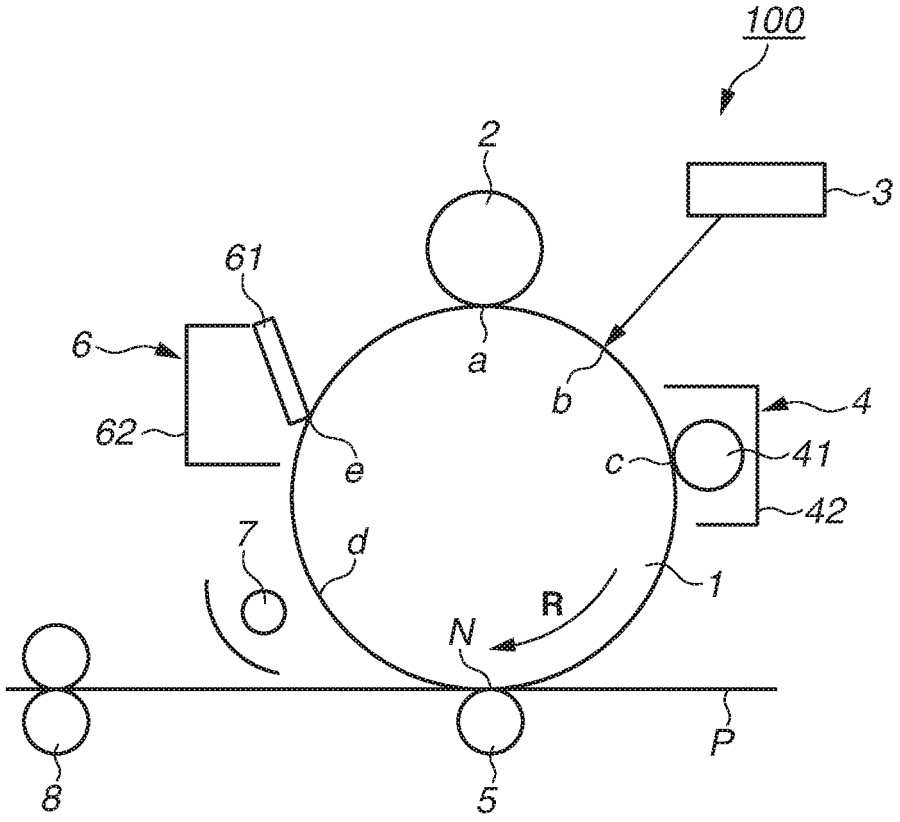
FIG. 1 is a cross-sectional view schematically illustrating an image forming apparatus.

FIG. 1 is a cross-sectional view schematically illustrating a structure of an image forming apparatus 100 according to a first exemplary embodiment. The image forming apparatus 100 includes a photosensitive drum 1 as an image bearing member which is a rotary, drum-shaped (cylindrical) electrophotographic photosensitive member (photosensitive member). The photosensitive drum 1 is driven and rotated in the direction of an arrow R in FIG. 1 by a drum driving motor M1 (FIG. 2) which is a driving member. The photosensitive drum 1 includes a drum-shaped conductive base material and an organic photosensitive layer formed on the surface of the drum-shaped conductive base material.

The surface of the photosensitive drum 1 being rotated is uniformly charged to a predetermined potential of predetermined polarity by a charging roller 2 as a charging member which is a roller-type charging member. In the present exemplary embodiment, the normal charging polarity of the photosensitive drum 1 is negative. The charging roller 2 includes a conductive metal core (core material) and an elastic layer formed around the conductive metal core. The elastic layer is made of a conductive or intermediate-resistive rubber material or foam. The elastic layer can include a plurality of layers stacked on top of another to have desired characteristics. The charging roller 2 is disposed in contact with the photosensitive drum 1. In the present exemplary embodiment, the charging roller 2 is pressed against the surface of the photosensitive drum 1 and is rotated to follow the rotation of the photosensitive drum 1. The charging roller 2 can be driven and rotated with a slight difference in speed from the photosensitive drum 1. During the charging, a charging voltage (charging bias) which is a negative direct-current (DC) voltage is applied to the charging roller 2 from a charging power source E1 (FIG. 2) which is an application member.

The charged surface of the photosensitive drum 1 is scanned and exposed (image exposure) with laser light applied according to image information by an image exposure device (laser scanner) 3 which is an image exposure member to form an electrostatic image (electrostatic latent image) on the photosensitive drum 1. The electrostatic image formed on the photosensitive drum 1 is developed (visualized) with a developer agent by a development device 4 which is a development member to form a toner image on the photosensitive drum 1. The development device 4 uses as the developer agent a two-component developer agent containing toner (non-magnetic toner particles) and carrier (magnetic carrier particles).

Figure 2:
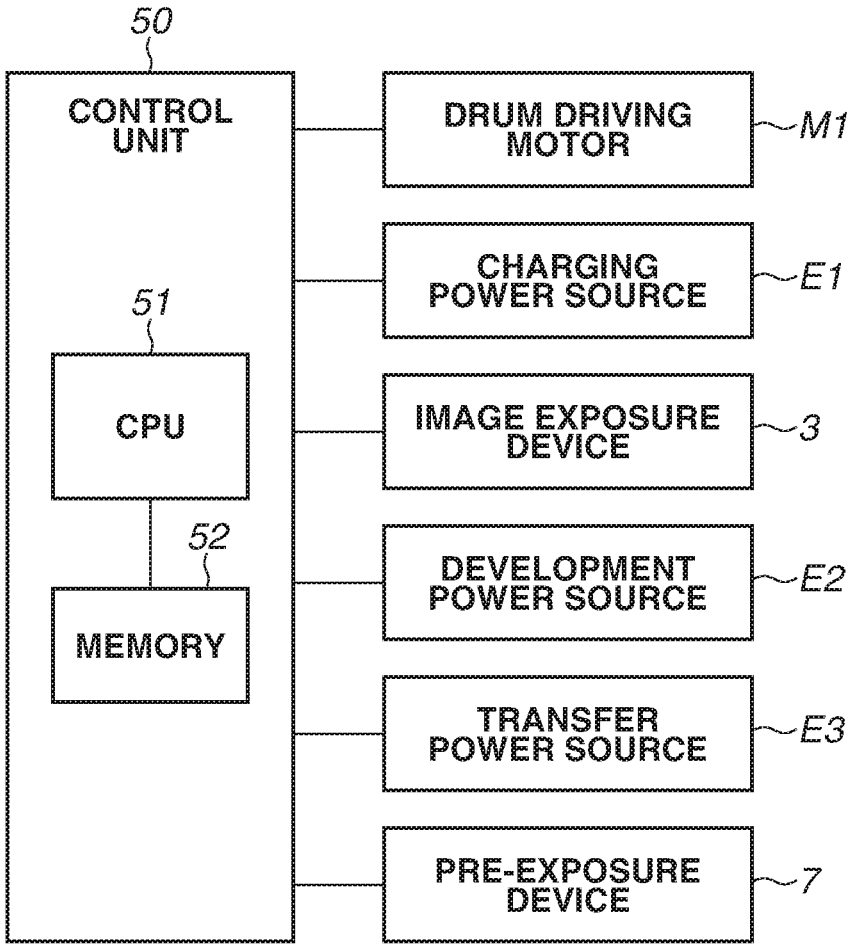
FIG. 2 is a block diagram schematically illustrating how a main part of the image forming apparatus is controlled.

The development device 4 includes a development sleeve 41 and a development container 42 which stores the developer agent. The development sleeve 41 as a developer agent bearing member bears and conveys the developer agent to an area facing the photosensitive drum 1. The development sleeve 41 has a hollow-cylindrical shape, and in the hollow portion of the development sleeve 41 is disposed a magnet roller (not illustrated) as a magnetic field generation member. The developer agent which is restrained on the development sleeve 41 by a magnetic field generated by the magnet roller and is conveyed to the area facing the photosensitive drum 1 is magnetically raised on the development sleeve 41 to come into contact with or near the photosensitive drum 1. Further, during the development, a predetermined development voltage (development bias) containing at least a DC voltage (DC component) is applied to the development sleeve 41 from a development power source E2 (FIG. 2). The potential of the DC component of the development voltage is set to a negative potential having an absolute value less than the absolute value of a charging potential (dark section potential) formed on the photosensitive drum 1 by the charging roller 2 and greater than the absolute value of the potential (light section potential) of an image portion exposed and formed by the image exposure device 3. Alternatively, an oscillating voltage in which a DC voltage (DC component) and an alternating-current (AC) voltage (AC component) are superimposed can be used as the development voltage. The toner contained in the developer agent on the development sleeve 41 is transferred onto the photosensitive drum 1 due to a potential difference between the potential of the image portion of the electrostatic image on the photosensitive drum 1 and the potential of the development sleeve 41. In the present exemplary embodiment, the toner charged to the same polarity as the normal charging polarity of the photosensitive drum 1 adheres to an exposed portion on the photosensitive drum 1 which has been uniformly charged and thereafter exposed to have a reduced absolute value of the potential. Specifically, in the present exemplary embodiment, the normal charging polarity of the toner, which is the charging polarity of the toner during the development, is negative.

A transfer roller 5, which is a roller-type transfer member, is disposed to face the photosensitive drum 1. The transfer roller 5 is pressed against the surface of the photosensitive drum 1 to form a transfer area N where the photosensitive drum 1 and the transfer roller 5 come into contact with each other. The transfer roller 5 is rotated to follow the rotation of the photosensitive drum 1. The toner image formed on the photosensitive drum 1 is transferred in the transfer area N by an electrostatic force and pressure applied by the transfer roller 5 onto a recording material P such as a sheet which is sandwiched between the photosensitive drum 1 and the transfer roller 5 and conveyed therethrough. During the transfer, a transfer voltage (transfer bias) which is a DC voltage of the opposite polarity (which is positive in the present exemplary embodiment) to the normal charging polarity of the toner is applied to the transfer roller 5 from a transfer power source E3 (FIG. 2). The recording material P is fed by a sheet feeding/conveying device (not illustrated) to the transfer area N at the same timing as the toner image on the photosensitive drum 1. The recording material P with the transferred toner image is conveyed to a fixing device 8, which is a fixing member, and heated and pressed by the fixing device 8 to fix (fuse and fix) the toner image, and thereafter the recording material P is discharged (output) to the outside of a main body of the image forming apparatus 100.

Further, the surface of the photosensitive drum 1 after the transfer is irradiated with light by a pre-exposure device 7, which is a pre-exposure member, to remove (neutralize) at least some of charges (residual charges) remaining on the photosensitive drum 1 after the transfer. The pre-exposure device 7 includes a light-emitting diode (LED) and a light guide. The LED as a light source is provided to at least one end portion side in the direction of the rotation axis line of the photosensitive drum 1. The light guide as a light guide member is disposed along the direction of the rotation axis line of the photosensitive drum 1 and guides light from the LED to the surface of the photosensitive drum 1. When the pre-exposure device 7 is driven, a substantially-constant current is applied to the LED to cause the LED to emit a predetermined amount of light. Further, the toner (untransferred residual toner) remaining on the photosensitive drum 1 after the transfer is removed and collected from the photosensitive drum 1 by a cleaning device 6 which is a cleaning member. The cleaning device 6 includes a cleaning blade 61 as a cleaning member and a cleaning container 62. The cleaning blade 61 of the cleaning device 6 which is disposed in contact with the photosensitive drum 1 scrapes the untransferred residual toner off the surface of the photosensitive drum 1 being rotated, and the untransferred residual toner is collected into the cleaning container 62.

The position at which the charging roller 2 performs charging processing in the rotation direction of the photosensitive drum 1 is a charging position a. In the present exemplary embodiment, the charging roller 2 charges the photosensitive drum 1 by an electric discharge which occurs in at least one of small spaces formed between the charging roller 2 and the photosensitive drum 1 on the upstream and downstream sides of a contact area of the charging roller 2 and the photosensitive drum 1 in the rotation direction of the photosensitive drum 1. To simplify the description, the contact area of the charging roller 2 and the photosensitive drum 1 can be considered as the charging position a. Further, the position at which the image exposure device 3 performs exposure in the rotation direction of the photosensitive drum 1 is an image exposure position b. Further, the position (which is the area where the development sleeve 41 and the photosensitive drum 1 face each other in the present exemplary embodiment) at which the toner is supplied from the development sleeve 41 to the photosensitive drum 1 in the rotation direction of the photosensitive drum 1 is a development position c. Further, the position (which is a contact area of the photosensitive drum 1 and the transfer roller 5 in the present exemplary embodiment) at which the toner image is transferred from the photosensitive drum 1 onto the recording material P in the rotation direction of the photosensitive drum 1 is the transfer position (transfer area) N. Further, the position at which the pre-exposure device 7 performs light irradiation in the rotation direction of the photosensitive drum 1 is a pre-exposure position d. More specifically, in the present exemplary embodiment, the pre-exposure device 7 irradiates with light a region of a predetermined width in the rotation direction (circumferential direction) of the photosensitive drum 1. At this time, the position at which the amount of exposure by the pre-exposure device 7 is the greatest in the region in the rotation direction of the photosensitive drum 1 is the pre-exposure position d. The amount of exposure by the pre-exposure device 7 refers to the amount of light with which the surface of the photosensitive drum 1 (per unit area) is irradiated per unit time. Further, a contact area where the cleaning blade 61 and the photosensitive drum 1 are in contact with each other in the rotation direction of the photosensitive drum 1 is a cleaning position e. In the present exemplary embodiment, the charging position a, the image exposure position b, the development position c, the transfer position N, the pre-exposure position d, and the cleaning position e described above are located in this order along the rotation direction of the photosensitive drum 1.

FIG. 2 is a block diagram schematically illustrating how a main part of the image forming apparatus 100 is controlled according to the present exemplary embodiment. In the present exemplary embodiment, a control unit (control circuit) 50 provided in the main body of the image forming apparatus 100 as a control unit comprehensively controls operations of each component of the image forming apparatus 100. The control unit 50 includes a central processing unit (CPU) 51 and a memory 52. The CPU 51 is a calculation control unit, and the memory 52 is a storage unit and includes a read-only memory (ROM) and a random-access memory (RAM). The CPU 51 controls the components of the image forming apparatus 100 according to a program stored in the memory 52. To the control unit 50 are connected the charging power source E1, the development power source E2, the transfer power source E3, the drum driving motor M1, the image exposure device 3, the pre-exposure device 7, etc. With regard to the present exemplary embodiment, the control unit 50 controls especially the timings of operations of the components at the time of causing a voltage, which is to be applied to the charging roller 2, to rise as described below.

2. Charging Processing

Figure 3:
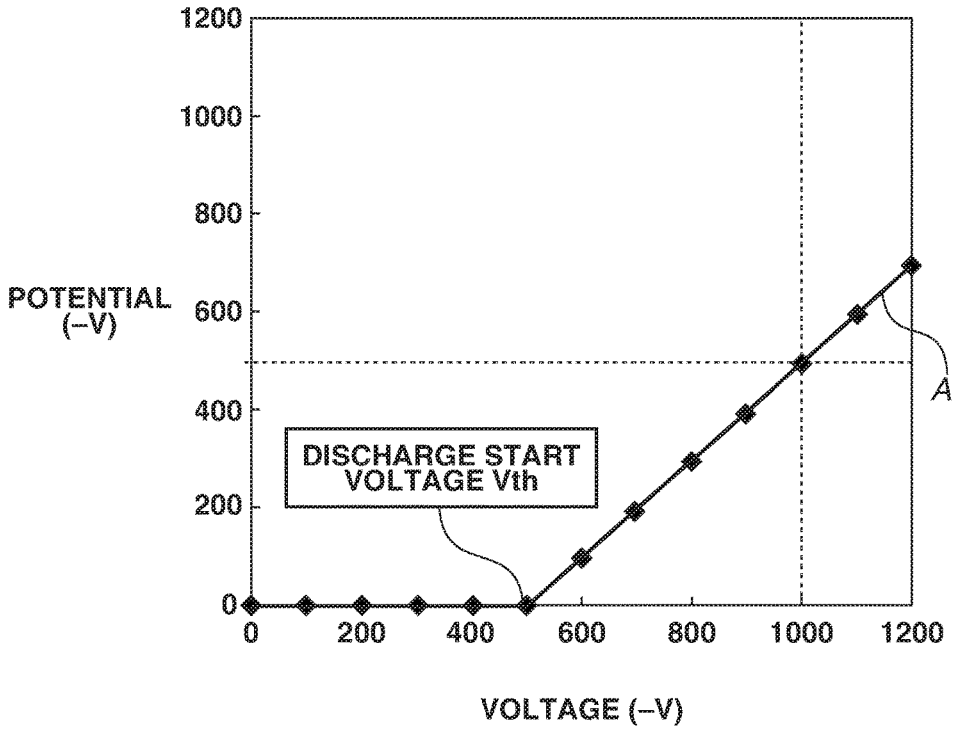
FIG. 3 is a graph illustrating a charging characteristic of a photosensitive drum by a charging roller.

In the present exemplary embodiment, the photosensitive drum 1 is charged by the DC charging method. FIG. 3 is a graph illustrating an example of a charging characteristic A of the photosensitive drum 1 by the charging roller 2 in the present exemplary embodiment. In FIG. 3, the horizontal axis represents DC voltages applied to the charging roller 2, and the vertical axis represents surface potentials of the photosensitive drum 1.

In the example illustrated in FIG. 3, if a negative DC voltage having a greater absolute value than the absolute value of a threshold value, which is minus 500 V, is applied to the charging roller 2, the surface of the photosensitive drum 1 is negatively charged. Then, in the range in which the absolute value of the DC voltage applied to the charging roller 2 is greater than the absolute value of the threshold voltage, which is minus 500 V, the absolute value of the surface potential of the photosensitive drum 1 increases substantially linearly to the absolute value of the DC voltage. The threshold voltage is defined as "discharge start voltage Vth". Specifically, in order to obtain a charging potential Vd of the photosensitive drum 1 for electrophotography, a DC voltage (target charging voltage) Vd+Vth needs to be applied to the charging roller 2. In the present exemplary embodiment, a case in which the discharge start voltage Vth is minus 500 V, the charging potential Vd of the photosensitive drum 1 during image formation is minus 500 V, and the target charging voltage Vd+Vth is minus 1000 V will be described as an example.

The discharge start voltage Vth varies according to the environment in which the image forming apparatus 100 is situated or according to a change in the electrical resistance value of the charging roller 2, the layer thickness of the photosensitive drum 1, etc. as a result of repeated use. The environment in which the image forming apparatus 100 is situated refers to, for example, at least one of the temperature and humidity (relative humidity or absolute moisture content). Thus, if characteristics of the discharge start voltage Vth which varies according to such various causes are obtained in advance by experiments, etc., the discharge start voltage Vth can be predicted based on the characteristics prior to the image formation. Then, during the image formation, the target charging voltage Vd+Vth (second voltage Vb having a greater absolute value than the absolute value of the discharge start voltage, which will be described below) changed based on the predicted discharge start voltage Vth can be applied to the charging roller 2. Further, a first voltage Va having an absolute value which is not greater than the discharge start voltage can also be changed based on the predicted discharge start voltage Vth as described above. The first voltage Va will be described below.

3. Rise of Charging Voltage

Next, operation sequences at the time of causing a voltage, which is to be applied to the charging roller 2 when a pre-rotation operation as a preparatory operation prior to the image formation is started, to rise will be described below.

3-1. Operation Sequence of Comparative Example

First, to make the present exemplary embodiment easy to understand, the operation sequence of a comparative example will be described below to be compared with the operation sequence of the present exemplary embodiment. The operation sequence of the comparative example is different from the operation sequence of the present exemplary embodiment in the timings to start applying the first voltage Va having an absolute value which is not greater than the discharge start voltage and the second voltage Vb having an absolute value which is greater than the discharge start voltage. The structure of the image forming apparatus 100 to which the operation sequence of the comparative example is applied is similar to that described above in the present exemplary embodiment.

Figure 4A:
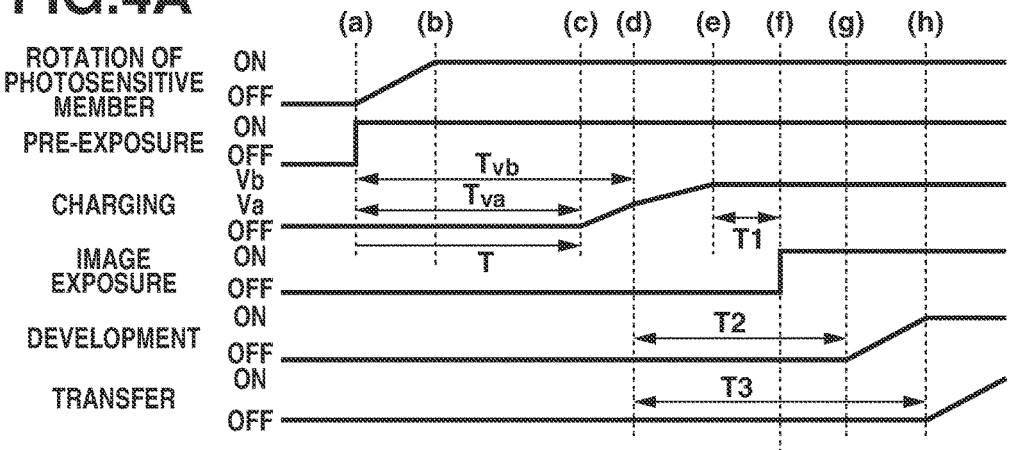
FIG. 4A is a timing chart illustrating an operation sequence at the time of causing a charging voltage to rise according to a comparative example.

FIG. 4A is a timing chart illustrating the operation sequence of the comparative example. In FIG. 4A, "rotation of the photosensitive member", "pre-exposure", "charging", "image exposure", "development", and "transfer" respectively indicate the states of the respective components as described below (the same applies to FIGS. 4B, 4C, 5A, 5B, and 5C described below). First, "rotation of the photosensitive member" indicates the state of the photosensitive drum 1 (on (stopped), off (rotated), or transient state between the on-state and the off-state). Further, "pre-exposure" indicates the state of the pre-exposure device 7 (on (turned on) or off (turned off)). Further, "charging" indicates the state of the voltage applied to the charging roller 2 (off, the first voltage Va, the second voltage Vb, or transient state between the off-state, the first voltage Va, and the second voltage Vb). Further, "image exposure" indicates the state of the image exposure device 3 (on (turned on) or off (turned off)). Further, "development" indicates the state of the voltage applied to the development sleeve 41 (on, off, or transient state between the on-state and the off-state). Further, "transfer" indicates the state of the voltage applied to the transfer roller 5 (on, off, or transient state between the on-state and the off-state).

In the operation sequence of the comparative example, at timing (a), the driving of the drum driving motor M1 is started, and the light irradiation by the pre-exposure device 7 is started substantially concurrently with the start of rotation of the photosensitive drum 1. Then, at timing (b) at which the driving of the drum driving motor M1 is stabilized, voltage application to the charging roller 2, image exposure by the image exposure device 3, voltage application to the development sleeve 41, and voltage application to the transfer roller 5 are not conducted.

Next, at or after timing (c) at which a predetermined position (hereinafter, also referred to as "pre-exposure start position") on the photosensitive drum 1 which is located at the pre-exposure position d when the light irradiation by the pre-exposure device 7 is started reaches the charging position a, application of the first voltage Va (e.g., minus 500 V) having an absolute value which is not greater than the discharge start voltage is started. In the illustrated example, the timing at which application of the first voltage Va is started is substantially the same as the timing (c). The first voltage Va is a voltage having no effect on the surface potential of the photosensitive drum 1.

Next, at or after timing (d) at which the rise of the first voltage Va is completed, application of the second voltage Vb (e.g., minus 1000 V) having an absolute value which is greater than the discharge start voltage is started. In the illustrated example, the timing (d) is substantially the same as the timing at which the rise of the first voltage Va is completed. The second voltage Vb is a voltage (target charging voltage Vd+Vth) which is used to obtain the desired charging potential Vd (e.g., minus 500 V).

As described above, the voltage to be applied to the charging roller 2 is caused to rise in two steps. Specifically, the voltage is caused to rise to the first voltage Va and thereafter to the second voltage Vb. In this way, the slope-shaped gradient of the potential from the start of application of the second voltage Vb to the completion of the rise of the second voltage Vb is made substantially constant. Then, as described below, when the voltage to be applied to the development sleeve 41 is caused to rise, the slope-shaped gradient of the potential of the development sleeve 41 can be sufficiently adjusted to the slope-shaped gradient of the charging potential. Thus, fog phenomena and carrier adhesion with respect to the region where the charging potential of the photosensitive drum 1 is caused to rise are prevented.

In FIG. 4A, "T" is a time from a point when the irradiation with light by the pre-exposure device 7 is started to a point when the pre-exposure start position reaches the charging position a. Further, "$T_{Va}$" is a time from the point when the irradiation with light by the pre-exposure device 7 is started to a point when application of the first voltage Va is started. Further, "$T_{Vb}$" is a time from the point when the irradiation with light by the pre-exposure device 7 is started to a point when application of the second voltage Vb is started.

At this time, the operation sequence of the comparative example satisfies the following relation formula, $$T \leq T_{Va} < T_{Vb}.$$

Next, at timing (e), the rise of the second voltage Vb is completed. Thereafter, at timing (f), image exposure based on image information by the image exposure device 3 is started, and formation of an electrostatic image is started. The timing of the start of the image exposure is at or after the timing at which a time T1 elapses since the timing (e) (which is substantially the same timing as the timing at which the time T1 elapses in the illustrated example). The time "T1" is a time needed for the surface of the photosensitive drum 1 to move from the charging position a to the image exposure position b. The surface potential of the photosensitive drum 1 at the image portion of the electrostatic image formed by the image exposure is a negative predetermined potential (e.g., minus 50 V) having an absolute value less than the absolute value of the charging potential (e.g., minus 500 V) formed by the charging roller 2.

Next, at timing (g), application of a voltage to the development sleeve 41 is started to obtain a development voltage (e.g., minus 400 V). The timing of the start of voltage application to the development sleeve 41 is at or after the timing at which a time T2 elapses since the timing (d) (which is substantially the same as the timing at which the time T2 elapses in the illustrated example). The time "T2" is a time needed for the surface of the photosensitive drum 1 to move from the charging position a to the development position c. Specifically, the voltage application to the development sleeve 41 is started to coincide with the timing at which a region of the photosensitive drum 1 (surface of the photosensitive drum 1 which passes through the charging position a between the timings (d) and (e)) in which the charging potential with the substantially constant slope-shaped gradient rises reaches the development position c. Further, the rise of the development voltage is completed before the position on the photosensitive drum 1, which is located at the image exposure position b at the timing (f) at which the image exposure is started, reaches the development position c. While the rotation of the development sleeve 41 is started in synchronization with the start of voltage application to the development sleeve 41 in the present exemplary embodiment, the rotation of the development sleeve 41 can be started in synchronization with the rotation of the photosensitive drum 1.

The voltage to be applied to the development sleeve 41 is caused to rise so that the slope-shaped gradient of the potential of the development sleeve 41 is sufficiently adjusted to the slope-shaped gradient of the charging potential. In this way, the potential difference between the charging potential of the photosensitive drum 1 and the potential of the development sleeve 41 is controlled within a range to sufficiently prevent occurrences of fog phenomena and carrier adhesion. The slope-shaped gradient of the surface potential of the photosensitive drum 1 and the slope-shaped gradient of the potential of the development sleeve 41 are to be adjusted so that the potential difference between the charging potential of the photosensitive drum 1 and the potential of the development sleeve 41 is within a range that can sufficiently prevent fog phenomena and carrier adhesion. Typically, the surface potential of the photosensitive drum 1 and the potential of the development sleeve 41 both have the same polarity (which is negative in the present exemplary embodiment) as the normal charging polarity of the photosensitive drum 1, and the potential difference between the potentials is maintained not to be greater than a fogging-removal potential difference Vback during image formation. The term "fogging-removal potential difference Vback" refers to the potential difference (difference) between the charging potential Vd of the photosensitive drum 1 and the potential of the development sleeve 41 (the potential of the DC component of the development voltage). The fogging-removal potential difference Vback is the potential difference between the charging potential Vd of the photosensitive drum 1 and the potential of the development sleeve 41 at the development position c.

Next, at timing (h), the voltage application to the transfer roller 5 is started to obtain a transfer voltage (e.g., plus 1000 V). The timing of the start of voltage application to the transfer roller 5 is at or after the timing at which a time T3 elapses since the timing (d) (which is substantially the same as the timing at which the time T3 elapses in the illustrated example). The time "T3" is a time needed for the surface of the photosensitive drum to move from the charging position a to the transfer position N. Specifically, the voltage application to the transfer roller 5 is started to coincide with the timing at which the position on the photosensitive drum 1 which is located at the charging position a at the timing (timing (d)) at which the application of the second voltage Vb to the charging roller 2 is started reaches the transfer position N. Further, the rise of the transfer voltage is to be completed before the timing at which the position on the photosensitive drum 1 which is located at the image exposure position b at the timing (f) at which the image exposure is started reaches the transfer position N. In this way, a transfer electric field capable of transferring toner images onto recording materials P is formed between the transfer roller 5 and the photosensitive drum 1.

Thereafter, the image exposure by the image exposure device 3, the application of the transfer voltage, the application of the charging voltage, the application of the development voltage, the driving of the drum driving motor M1, and the termination of the light irradiation by the pre-exposure device 7 are sequentially conducted at timings which are not illustrated.

3-2. Operation Sequence of Present Exemplary Embodiment

Next, the operation sequence of the present exemplary embodiment will be described below. As in the operation sequence of the comparative example described above, the surface of the photosensitive drum 1 irradiated with light by the pre-exposure device 7 is charged to uniform the surface potential of the photosensitive drum 1 after the surface passes through the charging position a. However, as in the operation sequence of the comparative example described above, if the voltage application to the charging roller 2 is started after the surface of the photosensitive drum 1 irradiated with light by the pre-exposure device 7 reaches the charging position a, the timing of the start of charging processing is delayed to increase FCOT.

Thus, in the present exemplary embodiment, the control unit 50 performs control described below at the time of causing the voltage to be applied to the charging roller 2 to rise. Specifically, the application of the first voltage Va having an absolute value which is not greater than the absolute value of the discharge start voltage is started before the pre-exposure start position reaches the charging position a. Further, the application of the second voltage Vb having an absolute value which is greater than the absolute value of the discharge start voltage is started at or after the timing at which the rise of the first voltage Va is completed. Then, the rise of the second voltage Vb is completed at or after the timing at which the pre-exposure start position reaches the charging position a. Especially, in the present exemplary embodiment, the control unit 50 performs control such that the application of second voltage Vb is started at or after the pre-exposure start position reaches the charging position a and the rise of the second voltage Vb is completed at or after the pre-exposure start position reaches the charging position a.

Figure 4B:
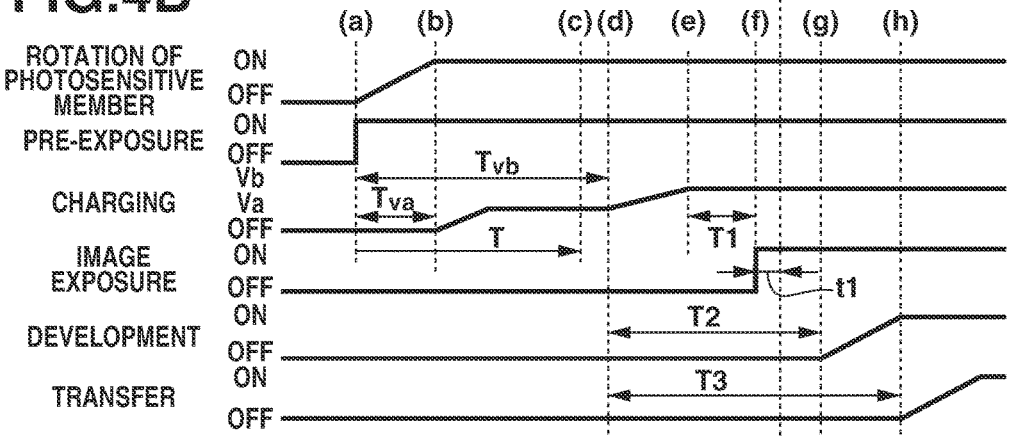
FIGS. 4B and 4C are timing charts illustrating an operation sequence at the time of causing a charging voltage to rise according to a first exemplary embodiment.

FIG. 4B is a timing chart illustrating a specific example of the operation sequence according to the present exemplary embodiment. In FIG. 4B, the definitions of "T", "$T_{Va}$", "$T_{Vb}$", "T1", "T2", and "T3" are similar to those described above with reference to FIG. 4A (and FIG. 4C). Description of the timings which are set similarly to those in the comparative example illustrated in FIG. 4A will be omitted.

In the operation sequence illustrated in FIG. 4B, the application of the first voltage Va (e.g., minus 500 V) is started at a timing at or after the timing (b) at which the driving of the drum driving motor M1 stabilizes and before the timing (c) at which the pre-exposure start position reaches the charging position a. In the illustrated example, the timing at which the application of the first voltage Va is started is substantially the same as the timing (b).

As described above, the first voltage Va is a voltage having no effect on the surface potential of the photosensitive drum 1. More specifically, the first voltage Va can be set to a voltage which acts as follows. Specifically, ordinarily, the potential of the surface of the photosensitive drum 1 between the pre-exposure position d and the charging position a in the rotation direction of the photosensitive drum 1 has the same polarity as the normal charging polarity of the photosensitive drum 1, and the absolute value of the potential is not greater than a fogging-removal potential difference Vback during image formation. Depending on the setting of the amount of exposure by the pre-exposure device 7, the surface of the photosensitive drum 1 in the position is substantially completely neutralized to have a surface potential which is substantially 0 V. Thus, as described above, even if the first voltage Va is applied to the charging roller 2, no charging processing is conducted on the photosensitive drum 1, and the first voltage Va does not affect the surface potential of the photosensitive drum 1. However, in a case where, for example, a jam (a phenomenon in which a recording material P is jammed in a sheet conveyance path) occurs, the surface potential of the photosensitive drum 1 having passed through the transfer position N can be inversed (hereinafter, also referred to as "changed to positive") to the opposite polarity to the normal charging polarity (which is negative in the present exemplary embodiment). The surface potential of the photosensitive drum 1 which is changed to positive is not neutralized by the light irradiation by the pre-exposure device 7 when the image formation is resumed, because the neutralization effect of the pre-exposure device 7 is produced by irradiating the photosensitive drum 1 with light to produce positive charge carriers, so that negative charges, which are the normal charging polarity of the photosensitive drum 1, are neutralized in the present exemplary embodiment. When the portion of the photosensitive drum 1 with the surface potential which is changed to positive reaches the development position c, a fog phenomenon can occur. Thus, an electric discharge is caused to occur by the potential difference between the first voltage Va and the surface potential of the photosensitive drum 1 which is changed to positive, and the potential of the surface of the photosensitive drum 1 having passed through the charging position a is adjusted to a potential that can sufficiently prevent occurrences of fog phenomena and carrier adhesion. Specifically, the first voltage Va can be set such that the potential of the surface of the photosensitive drum 1 having passed through the charging position a without being irradiated with light by the pre-exposure device 7 has the same polarity as the normal charging polarity of the photosensitive drum 1 and the absolute value of the potential is not greater than the fogging-removal potential difference. Typically, as in the present exemplary embodiment, the first voltage Va is set to a voltage close to the discharge start voltage Vth (the first voltage Va can be substantially the same as the discharge start voltage Vth).

Next, the application of the second voltage Vb (e.g., minus 1000 V) is started at the timing (d) which is after the timing (c) at which the pre-exposure start position reaches the charging position a.

As described above, the operation sequence illustrated in FIG. 4B satisfies the following relation formula $$T_{Va}<T<T_{Vb}.$$

In this way, the timing (f) to start the image exposure is expedited by t1 (=$T_{Vb}$−T) in FIG. 4B, compared with the operation sequence of the comparative example illustrated in FIG. 4A.

Figure 4C:
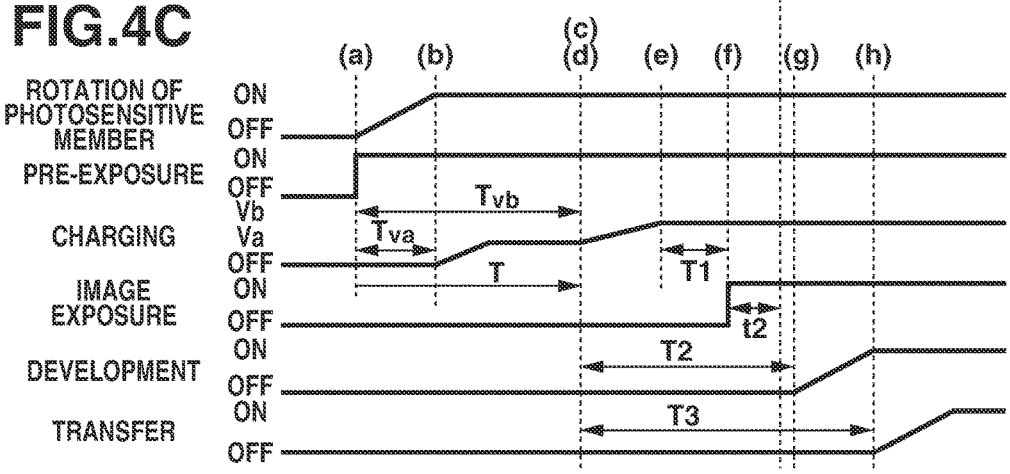

FIG. 4C is a timing chart illustrating an operation sequence as another specific example according to the present exemplary embodiment. Description of the timings that are set similarly to those in the specific example illustrated in FIG. 4B will be omitted.

In the operation sequence illustrated in FIG. 4C, the application of the second voltage Vb (e.g., minus 1000 V) is started at the timing (d) which is substantially the same timing as the timing (c) at which the pre-exposure start position reaches the charging position a (timing (c) =timing (d)).

As described above, the operation sequence illustrated in FIG. 4C satisfies the following relation formula $$T_{Va}<T=T_{Vb}.$$

In this way, the timing (f) to start the image exposure is expedited by t2 (=the time from the point when the application of the first voltage Va is started to the point when the rise of the first voltage Va is completed (the rise time of the first voltage Va)) in FIG. 4C, compared with the operation sequence of the comparative example illustrated in FIG. 4A.

As described above, in the present exemplary embodiment, the application of the first voltage Va is started before the surface of the photosensitive drum 1 irradiated with light by the pre-exposure device 7 reaches the charging position a when the voltage to be applied to the charging roller 2 is caused to rise. Further, the rise of the second voltage Vb is started at or after the point when the surface of the photosensitive drum 1 irradiated with light by the pre-exposure device 7 reaches the charging position a. Specifically, in the present exemplary embodiment, the control unit 50 performs control to satisfy the following formula $T_{Va}<T\leq T_{Vb}$. In this way, an abnormal potential of the photosensitive drum 1 before the image formation is prevented, and the timing to start the image exposure on the charging potential of the photosensitive drum 1, which is uniform and suitable for image formation, is expedited. Accordingly, FOOT is shortened to improve productivity.

Next, a second exemplary embodiment of the disclosure will be described below. The basic structure and operation of an image forming apparatus according to the present exemplary embodiment are similar to those of the image forming apparatus according to the first exemplary embodiment. Thus, elements of the image forming apparatus according to the present exemplary embodiment that have a similar or corresponding function or structure to that of the image forming apparatus according to the first exemplary embodiment are given the same reference numerals, and description thereof is omitted.

In the present exemplary embodiment, the control unit 50 performs control such that the application of the second voltage Vb is started before the pre-exposure start position reaches the charging position a and the rise of the second voltage Vb is completed at or after the point when the irradiation position reaches the charging position a.

Figure 5A:
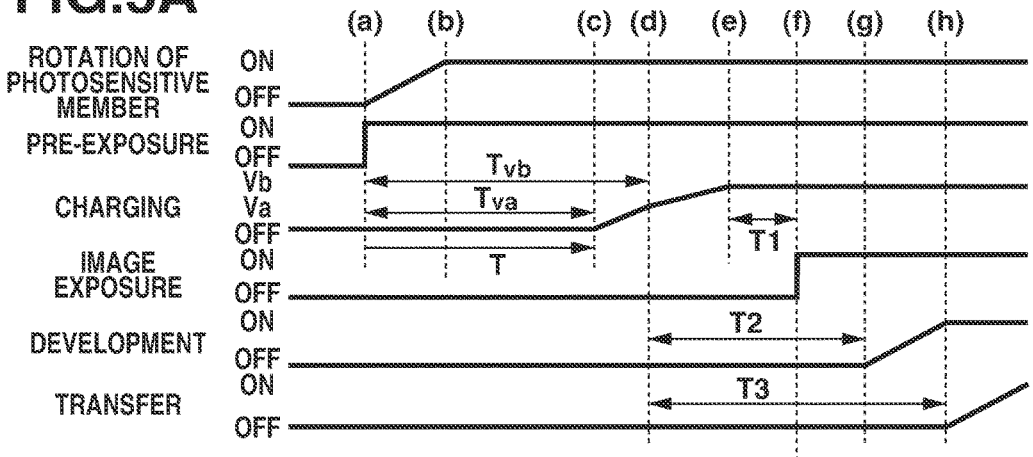
FIG. 5A is a timing chart illustrating an operation sequence at the time of causing a charging voltage to rise according to a comparative example.
Figure 5B:
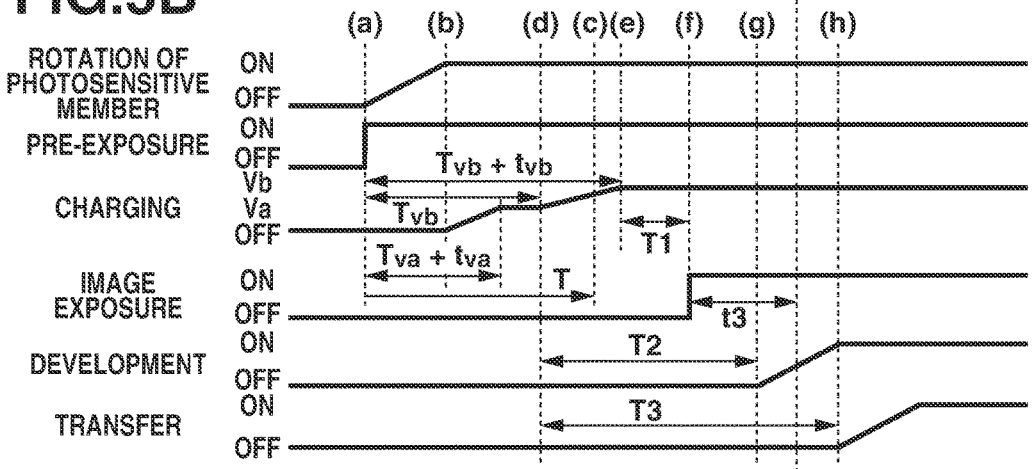
FIGS. 5B and 5C are timing charts illustrating an operation sequence at the time of causing a charging voltage to rise according to a second exemplary embodiment.
Figure 5C:
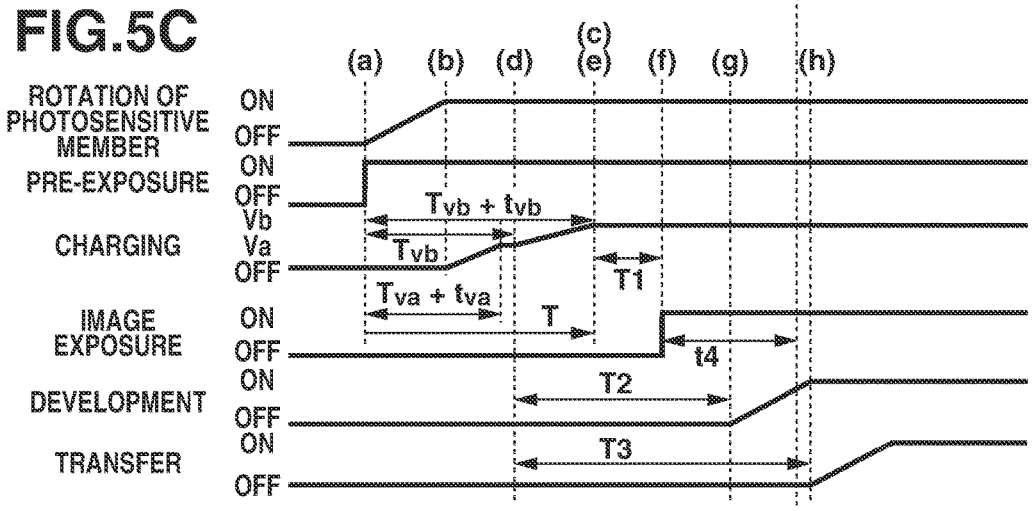

FIG. 5B is a timing chart illustrating a specific example of the operation sequence according to the present exemplary embodiment. FIG. 5A illustrates the operation sequence of the comparative example (which is the same as the operation sequence illustrated in FIG. 4A) for comparison with the present exemplary embodiment. The definitions of "T", "$T_{Va}$", "$T_{Vb}$", "T1", "T2", and "T3" in FIG. 5B are the same as those described above with reference to FIG. 4A (the definitions in FIG. 5C are also the same). Further, "$t_{Va}$" in FIG. 5B indicates the time from the point when the application of the first voltage Va is started to the point when the rise of the first voltage Va is completed (rise time of the first voltage Va). Further, "$t_{Vb}$" indicates the time from the point when the application of the second voltage Vb is started to the point when the rise of the second voltage Vb is completed (rise time of the second voltage Vb) (the definitions in FIG. 5C are also the same).

In the operation sequence illustrated in FIG. 5B, the application of the first voltage Va (e.g., minus 500 V) is started at or after the timing (b) at which the driving of the drum driving motor M1 stabilizes and before the timing (c) at which the pre-exposure start position reaches the charging position a. In the illustrated example, the timing at which the application of the first voltage Va is started is substantially the same timing as the timing (b).

Next, the application of the second voltage Vb (e.g., minus 1000 V) is started at the timing (d) which is before the timing (c) at which the pre-exposure start position reaches the charging position a. The timing (d) is at or after (after the timing at which $T_{Va}+t_{Va}$ elapses in the illustrated example) the timing at which the time $T_{Va}+t_{Va}$ from the point when the light irradiation by the pre-exposure device 7 is started to the point when the rise of the first voltage Va is completed elapses. Then, the rise of the second voltage Vb is completed at the timing (e) after the timing (c). In other words, the timing (e) at which the time $T_{Vb}+t_{Vb}$ from the point when the light irradiation by the pre-exposure device 7 is started to the point when the rise of the second voltage Vb is completed elapses is after the timing (c).

As described above, the operation sequence illustrated in FIG. 5B satisfies the following relation formula $$T_{Va}+t_{Va}\leq T_{Vb}<T<T_{Vb}+t_{Vb}.$$

In this way, the timing (f) to start the image exposure is expedited by t3 ($=t_{Va}+T-T_{Vb}$) in FIG. 5B, compared with the operation sequence of the comparative example illustrated in FIG. 5A.

FIG. 5C is a timing chart illustrating an operation sequence as another specific example according to the present exemplary embodiment. Description of the timings that are set similarly to those in the specific example illustrated in FIG. 5B will be omitted.

In the operation sequence illustrated in FIG. 5C, the rise of the second voltage Vb is completed at the timing (e) which is substantially the same timing as the timing (c) at which the pre-exposure start position reaches the charging position a (timing (c)=timing (e)). In other words, the timing (e) at which the time $T_{Vb}+t_{Vb}$ from the point when the light irradiation by the pre-exposure device 7 is started to the point when the rise of the second voltage Vb is completed elapses is substantially the same timing as the timing (c).

As described above, the operation sequence illustrated in FIG. 5C satisfies the following relation formula $$T_{Va}+t_{Va}\leq T_{Vb}<T=T_{Vb}+t_{Vb}.$$

In this way, the timing (f) to start the image exposure is expedited by t4 ($=t_{Va}+t_{Vb}$) in FIG. 5C, compared with the operation sequence of the comparative example illustrated in FIG. 5A.

As described above, in the present exemplary embodiment, the application of the first voltage Va is started before the surface of the photosensitive drum 1 irradiated with light by the pre-exposure device 7 reaches the charging position a when the voltage to be applied to the charging roller 2 is caused to rise. Further, the application of the second voltage Vb is started before the surface of the photosensitive drum 1 irradiated with light by the pre-exposure device 7 reaches the charging position a. Then, the rise of the second voltage Vb is completed at or after the point when the surface of the photosensitive drum 1 irradiated with light by the pre-exposure device 7 reaches the charging position a. Specifically, in the present exemplary embodiment, the control unit 50 performs control to satisfy the following formula $T_{Va}+t_{Va}\leq T_{Vb}<T\leq T_{Vb}+t_{Vb}$. In this way, an abnormal potential of the photosensitive drum 1 before the image formation is prevented, and FCOT is further shortened from that in the first exemplary embodiment to improve productivity.

While the disclosure has been described with reference to exemplary embodiments, the disclosed exemplary embodiments are not intended to limit the scope of the disclosure.

While the characteristics which vary according to various factors are obtained in advance by experiments, etc. and the discharge start voltage Vth is predicted based on the characteristics in the above-described exemplary embodiments, the aspect of the embodiments is not limited to the disclosure. In the image forming apparatus, the currents at the points when a plurality of test voltages is applied to the charging member can be measured to obtain a current-voltage characteristic, and the discharge start voltage Vth can be calculated from the characteristics. Typically, one or more voltages lower than the discharge start voltage Vth and two or more voltages higher than the discharge start voltage Vth are applied, and the currents which flow in the charging power source (the currents can be currents that flow to the ground via the photosensitive member) when the respective voltages are applied are measured. In this way, the current-voltage characteristic corresponding to FIG. 3 with the vertical axis replaced by the current is obtained. Then, the discharge start voltage Vth can be obtained from an inflection point (which corresponds to, roughly, the voltage value at the current of zero on the straight line indicating the current-voltage characteristic in the voltage range greater than the discharge start voltage Vth) of the obtained straight line. The operation of obtaining the discharge start voltage Vth is performed at a predetermined timing, for example, during a period other than the period of image forming in which an image to be transferred onto a recording material and output is formed. The predetermined timing can be set to a timing at which the environment (at least one of the temperature and humidity) is changed beyond a predetermined range, a timing at which an index value correlating with the amount of use of the charging member or the photosensitive member exceeds a predetermined threshold, etc. Further, examples of the period other than the period of image formation include a period of a pre-rotation operation which is a preparatory operation prior to the image formation, a period between recording materials during the continuous image formation on a plurality of recording materials, a period of a post-rotation operation which is an organizing operation (preparatory operation) after the image formation. Further, any value such as the number of rotations, the rotation time, the number of times the charging processing is conducted, or the number of images formed can be used as the index value correlating with the amount of use of the charging member or the photosensitive member.

Further, while the application of the first voltage Va is started at or after the timing at which the driving of the drum driving motor stabilizes in the above-described exemplary embodiments, the aspect of the embodiments is not limited to the disclosure. The application of the first voltage Va can be started before the timing at which the driving of the drum driving motor stabilizes as long as the condition formula specified in the above-described exemplary embodiments is satisfied.

Further, in the case in which the pre-exposure device irradiates with light the region of the predetermined width in the rotation direction (circumferential direction) of the photosensitive drum, the position at which the amount of exposure by the pre-exposure device is the greatest in the region in the rotation direction of the photosensitive drum is determined as the pre-exposure position d in the above-described exemplary embodiments. Alternatively, in a case where the amount of exposure by the pre-exposure device is large enough for a neutralization effect, a position in the region of the predetermined width in which the amount of exposure is the minimum for obtaining a neutralization effect and which is the closest position to the charging position can be set as the pre-exposure position d.

Further, while the case in which the aspect of the embodiments is applied to the image forming apparatus of a direct transfer method in which a toner image on the photosensitive member is transferred directly onto a recording material is described as an example in the above-described exemplary embodiments, the present invention is not limited to the disclosure. The aspect of the embodiments is also applicable to image forming apparatuses of an intermediate transfer method in which a toner image on the photosensitive member is transferred onto an intermediate transfer member, which is a primary transfer, and then onto a recording material, which is a secondary transfer.

Further, aspect of the embodiments is applicable to various image forming apparatuses such as printers, copying machines, facsimile machines, or multi-function peripherals having two or more of print, copy, and facsimile functions.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-056257, filed Mar. 22, 2017, which is hereby incorporated by reference herein in its entirety.

What is claimed is:

1. An apparatus comprising:

a photosensitive member;

a driving source configured to rotate the photosensitive member;

a charging roller configured to charge the photosensitive member to a predetermined surface potential at a charging position;

a first power source configured to apply to the charging roller a charging voltage of a direct current, wherein the charging voltage includes a first voltage and a second voltage, and wherein an absolute value of the first voltage is higher than zero volts and not higher than a discharge start voltage and an absolute value of the second voltage is higher than the discharge start voltage;

an image exposure device configured to form an electrostatic image on the photosensitive member by exposing, according to an image signal, the charged photosensitive member to which the second voltage is applied;

a development device including a development sleeve and configured to supply toner to the electrostatic image on the photosensitive member at a development position to form a toner image;

a second power source configured to apply to the development sleeve a development bias containing a direct-current component;

a transfer member configured to transfer the toner image on the photosensitive member onto a transfer-target member at a transfer position;

a pre-exposure member configured to irradiate the photosensitive member with light at a pre-exposure position located downstream of the transfer position and upstream of the charging position in a rotation direction of the photosensitive member; and a control unit configured to cause, in a case where the charging roller charges the photosensitive member after the driving source starts rotating the photosensitive member, after causing the charging voltage to rise to the first voltage, the charging voltage to rise from the first voltage to the second voltage so that a temporal change in an absolute value of the charging voltage has a predetermined rise shape and configured to cause the development bias to rise so that an absolute value of the direct-current component of the development bias has the rise shape when a charged region of the photosensitive member passes through the development position, the control unit performing control to satisfy $$T_{Va}+t_{Va}\leq T_{Vb}<T\leq T_{Vb}+t_{Vb},$$

where T is a time from a point when the irradiation with the light by the pre-exposure member is started to a point when a predetermined portion of the photosensitive member which is located at the pre-exposure position when the irradiation is started reaches the charging position, $T_{Va}$ is a time from the point when the irradiation is started to a point when application of the first voltage is started, $t_{Va}$ is a time from the point when the application of the first voltage is started to a point when a rise of the first voltage is completed, $T_{Vb}$ is a time from the point when the irradiation is started to a point when application of the second voltage is started, and $t_{Vb}$ is a time from the point when the application of the second voltage is started to a point when a rise of the second voltage is completed.

2. The apparatus according to claim 1, wherein the control unit starts applying the development bias when or after a region of the photosensitive member which is located at the charging position when the application of the second voltage starts to reach the development position.

3. The apparatus according to claim 1, wherein the control unit sets the charging voltage and a direct-current component of the development bias so that an absolute value of a difference between a surface potential of the photosensitive member and the direct-current component of the development bias at a point when the charged region of the photosensitive member passes through the development position is not greater than an absolute value of a difference between the surface potential of the photosensitive member and the direct-current component of the development bias at a point when the charged region of the photosensitive member passes through the development position without being exposed by the image exposure device after being charged by the charging roller during image formation.

4. The apparatus according to claim 1, wherein the rise shape is a slope shape having a substantially constant gradient.

5. The apparatus according to claim 1, wherein the first voltage is substantially a discharge start voltage.

6. The apparatus according to claim 1, wherein the pre-exposure position is a position where an amount of the light with which the photosensitive member is irradiated by the pre-exposure member is a greatest amount in the rotation direction of the photosensitive member.

7. The apparatus according to claim 1, wherein in a rotation axis direction of the photosensitive member, the charging roller is in contact with a surface of the photosensitive member in a region where the photosensitive member is to be charged.

8. The apparatus according to claim 1, wherein the development device uses developer agent containing the toner and carrier.

9. An apparatus comprising:

a photosensitive member;

a driving source configured to rotate the photosensitive member;

a charging roller configured to charge the photosensitive member to a predetermined surface potential at a charging position;

a first power source configured to apply to the charging roller a charging voltage of a direct current, wherein the charging voltage includes a first voltage and a second voltage, and wherein an absolute value of the first voltage is higher than zero volts and not higher than a discharge start voltage and an absolute value of the second voltage is higher than the discharge start voltage;

an exposure device configured to form an electrostatic image on the photosensitive member by exposing, according to an image signal, the photosensitive member charged by the charging roller to which the second voltage is applied;

a development device including a development sleeve and configured to supply toner to the electrostatic image on the photosensitive member at a development position to form a toner image;

a second power source configured to apply to the development sleeve a development bias containing a direct-current component;

a transfer member configured to transfer the toner image on the photosensitive member onto a transfer-target member at a transfer position;

a pre-exposure member configured to irradiate the photosensitive member with light at a pre-exposure position located downstream of the transfer position and upstream of the charging position in a rotation direction of the photosensitive member; and a control unit configured to cause, in a case where the charging roller charges the photosensitive member after the driving source starts rotating the photosensitive member, after causing the charging voltage to rise to the first voltage, the charging voltage to rise from the first voltage to the second voltage so that a temporal change in an absolute value of the charging voltage has a predetermined rise shape and configured to cause the development bias to rise so that an absolute value of the direct-current component of the development bias has the rise shape when a charged region of the photosensitive member passes through the development position, the control unit performing control to satisfy $$T_{Va}<T\leq T_{Vb},$$

where T is a time from a point when the irradiation with the light by the pre-exposure member is started to a point when a predetermined portion of the photosensitive member which is located at the pre-exposure position when the irradiation is started reaches the charging position, $T_{Va}$ is a time from the point when the irradiation is started to a point when application of the first voltage is started, and $T_{Vb}$ is a time from the point when the irradiation is started to a point when application of the second voltage is started.

10. The apparatus according to claim 9, wherein the control unit starts applying the development bias when or after a region of the photosensitive member which is located at the charging position when the application of the second voltage is started reaches the development position.

11. The apparatus according to claim 9, wherein the control unit sets the charging voltage and the direct-current component of the development bias so that an absolute value of a difference between the surface potential of the photosensitive member and the direct-current component of the development bias at a point when the charged region of the photosensitive member passes through the development position is not greater than an absolute value of a difference between the surface potential of the photosensitive member and the direct-current component of the development bias at a point when the charged region of the photosensitive member passes through the development position without being exposed by the image exposure device after being charged by the charging roller during image formation.

12. The apparatus according to claim 9, wherein the rise shape is a slope shape having a substantially constant gradient.

13. The apparatus according to claim 9, wherein the first voltage is substantially a discharge start voltage.

14. The apparatus according to claim 9, wherein the pre-exposure position is a position where an amount of the light with which the photosensitive member is irradiated by the pre-exposure member is a greatest amount in the rotation direction of the photosensitive member.

15. The apparatus according to claim 9, wherein in a rotation axis direction of the photosensitive member, the charging roller is in contact with a surface of the photosensitive member in a region where the photosensitive member is to be charged.

16. The apparatus according to claim 9, wherein the development device uses developer agent containing the toner and carrier.

17. A method comprising:

rotating a photosensitive member by a driving source;

charging the photosensitive member to a predetermined surface potential at a charging position by a charging roller;

applying, to the charging roller a charging voltage of a direct current, wherein the charging voltage includes a first voltage and a second voltage, and wherein an absolute value of the first voltage is higher than zero volts and not higher than a discharge start voltage and an absolute value of the second voltage is higher than the discharge start voltage;

forming an electrostatic image on the photosensitive member by exposing, according to an image signal, the charged photosensitive member to which the second voltage is applied;

supplying, by a development device including a sleeve, toner to the electrostatic image on the photosensitive member at a development position to form a toner image;

applying, to the sleeve a development bias containing a direct-current component;

transferring the toner image on the photosensitive member onto a transfer-target member at a transfer position;

irradiating the photosensitive member with light at a pre-exposure position located downstream of the transfer position and upstream of the charging position in a rotation direction of the photosensitive member; and performing control, in a case where the charging roller charges the photosensitive member after the driving source starts rotating the photosensitive member, after causing the charging voltage to rise to the first voltage, the charging voltage to rise from the first voltage to the second voltage so that a temporal change in an absolute value of the charging voltage has a predetermined rise shape and configured to cause the development bias to rise so that an absolute value of the direct-current component of the development bias has the rise shape when a charged region of the photosensitive member passes through the development position, to satisfy $$T_{Va}+t_{Va}\leq T_{Vb}<T\leq T_{Vb}+t_{Vb},$$

where T is a time from a point when the irradiation with the light by the pre-exposure member is started to a point when a predetermined portion of the photosensitive member which is located at the pre-exposure position when the irradiation is started reaches the charging position, $T_{Va}$ is a time from the point when the irradiation is started to a point when application of the first voltage is started, $t_{Va}$ is a time from the point when the application of the first voltage is started to a point when a rise of the first voltage is completed, $T_{Vb}$ is a time from the point when the irradiation is started to a point when application of the second voltage is started, and $t_{Vb}$ is a time from the point when the application of the second voltage is started to a point when a rise of the second voltage is completed.

18. The method according to claim 17, wherein the performing control starts applying the development bias when or after a region of the photosensitive member which is located at the charging position when the application of the second voltage starts to reach the development position.

19. The method according to claim 17, further comprising setting the charging voltage and a direct-current component of the development bias so that an absolute value of a difference between a surface potential of the photosensitive member and the direct-current component of the development bias at a point when the charged region of the photosensitive member passes through the development position is not greater than an absolute value of a difference between the surface potential of the photosensitive member and the direct-current component of the development bias at a point when the charged region of the photosensitive member passes through the development position without being exposed by the image exposure device after being charged by the charging roller during image formation.

20. The method according to claim 17, wherein the rise shape is a slope shape having a substantially constant gradient.

* * * * *